United States Patent [19]

Argon

[11] Patent Number: 4,708,052

[45] Date of Patent: Nov. 24, 1987

[54] HEIGHT ADJUSTMENT APPARATUS FOR THE FIRING BARREL OF A SHELL LAUNCHER

[75] Inventor: Gideon Argon, Tel-Aviv, Israel

[73] Assignee: Salgad International Ltd., Cayman Insel, Jamaica

[21] Appl. No.: 897,496

[22] Filed: Aug. 18, 1986

[30] Foreign Application Priority Data

Feb. 6, 1986 [DE] Fed. Rep. of Germany ..... 3603623

[51] Int. Cl.[4] ..... F41F 21/04

[52] U.S. Cl. ..... 89/41.01; 89/38; 89/40.02

[58] Field of Search ..... 89/1.3, 1.35, 37.05, 89/38, 40.02, 41.01, 43.01

[56] References Cited

U.S. PATENT DOCUMENTS 1,700,902 2/1929 Le Prieur ..... 89/41.01
3,501,997 3/1970 Winsen et al. ..... 89/1.3

FOREIGN PATENT DOCUMENTS 561549 10/1957 Belgium ..... 89/37.05
2328810 1/1975 Fed. Rep. of Germany ..... 89/1.3

*Primary Examiner*—Stephen C. Bentley
*Attorney, Agent, or Firm*—Neil F. Markva

[57] ABSTRACT

Height adjustment apparatus for the firing barrel of a shell launcher includes a mounting mechanism which pivotally supports the firing barrel about an axis of rotation for movement to various tilt positions. A further support device pivotally connects at a point along the firing barrel and laterally displaced from the axis of rotation. The support device includes an upper support section, a lower support section and a joint intermediate mechanism for pivotally moving the upper support section between an extended rest position and a bent position with respect to the lower support section. The firing barrel is in a firing position when the upper support section is in an extended rest position and in a stored position when the upper support section is in the bent position.

19 Claims, 4 Drawing Figures

HEIGHT ADJUSTMENT APPARATUS FOR THE FIRING BARREL OF A SHELL LAUNCHER

FIELD OF THE INVENTION

This invention relates to a height adjustment apparatus for the firing barrel of a shell launcher. More particularly, the invention relates to a height adjustment apparatus for changing the tilt position of a projector barrel around an axis of rotation including a support mechanism which is adjustable in length.

BACKGROUND OF THE INVENTION

Known shell launchers include a projector or firing barrel that is closed at the lower end and the shell to be fired is inserted into the projector barrel from above. Thus, the shell slides downwardly in the projector barrel and hits the ignition mechanism located in the closed closure cap. Ignition of the propellant charge located in the tail barrel of a fin-stabilized projectile occurs upon hitting the ignition mechanism. Hence, the fin-stabilized projectile is centrifuged or fired out of the projector barrel which may have a smooth inner wall.

A generally spherical breech ring is located on the closure cap of the barrel to engage a base plate which is firmly anchored on a provided base or the ground. A support mechanism generally constructed as a bipod determines the tilt position of the projector barrel. Such a known support mechanism pivotally engages the upper portion of the projector barrel at a point laterally displaced from the axis of rotation of the projector barrel.

To change the tilt position of the projector barrel, the known bipod support mechanism may be adjusted in length. A joint mechanism, generally a Cardan joint, is located between the bipod and the pivotal coupling means on the projector barrel. Furthermore, the tilt position of the projector barrel when pivotally mounted to the base plate may be adjusted by the particular position of the bipod itself. That is, when the bipod is disposed at a steep slope, the projector barrel is higher and when it is at a lesser slope, the projector barrel is at a lower tilt position. It is not possible to quickly change the angular position of the projector barrel for such special purposes as placing the barrel into a stored position.

SUMMARY OF THE INVENTION

The primary object of the invention is to produce a height adjustment apparatus for the projector barrel of a shell launcher wherein the tilt position of the projector barrel may be changed in a sudden and simple manner without the height adjustment mechanism of the apparatus having to be changed.

The height adjustment apparatus of the invention comprises means mounting a firing barrel to pivot about an axis of rotation for movement to various tilt positions. Support means is pivotally connected at a point along the firing barrel and laterally displaced from the axis of rotation. The support means includes an upper support section, a lower support section, and intermediate joint means for pivotally moving the upper support section between an extended rest position and a bent position with respect to the lower support section. The firing barrel is in a firing position when the upper support section is in the extended rest position and in a stored position when the upper support section is in the bent position.

The height adjustment apparatus having an intermediate joint means makes it possible for the tilt position of the projector barrel to suddenly be brought into a flat angular position. For example, such a flat angular or stored position is required when the shell launcher has to be brought under cover to a certain extent so that the projector barrel no longer projects outwardly as is necessary for firing a fin-stabilized shell. The joint means of the support mechanism allows the projector barrel to be laid flat without the adjusting mechanism of the support having to be changed in its setting. Once the support means is brought again into its extended position, the projector barrel is ready for firing. The joint means used for bending the apparatus is a simple construction and is easy to handle.

Another feature of the invention includes the combination of the projector barrel mounted in a cradle by transverse pins so that the firing barrel may pivot about an axis of rotation for movement to various tilt positions. The support means is pivotally connected at a point along the firing barrel and laterally displaced from the axis of rotation. The projector barrel is mounted within a recoil brake mechanism mounted in the cradle by transverse pins while the height-adjustment support mechanism is pivotally mounted on the recoil brake mechanism.

The combination of features of the disposition of the support means, the recoil brake mechanism, and the projector barrel has the particular advantage that shell launchers can be used with larger caliber projector barrels having a wider firing range. At the same time, such a shell launcher may be mounted in a vehicle so that it is mobile while not requiring any special reinforcement of the vehicle substructure for absorbing the recoil upon firing the shell launcher. Thus, there is a distinct advantage of bringing the comparatively steeply disposed projector barrel in a vehicle into such a flat stored position after the fin-stabilized shell has been fired that the projector barrel can disappear inside the normal structure of the vehicle. The shell launcher or projector barrel is thereby hidden from view.

With the intermediate joint support means of the height adjustment apparatus, the projector barrel may be brought quickly into the steep firing position from a flat, stored position as quickly as it was placed into the stored position. That is, the support mechanism simply is changed into the extended position from a bent position in an easy, quick manner. The firing tilt position of the projector barrel is thus held in place by the steep support of the height adjustment apparatus while the support mechanism is maintained in the locked, extended rest position.

The height adjustment apparatus includes means for longitudinally extending the length of the support means which is advantageously located in the lower support section. The upper support section bends inwardly in a direction toward the firing barrel at a location above the longitudinally adjusting means. The support means includes an intermediate support section mounted to move longitudinally with respect to the lower support section and is pivotally connected to the upper support section. The adjusting means includes a longitudinally adjusting barrel member having an outer end connected to the intermediate support section which includes a transverse bore extending in a direction transverse to the direction of longitudinal movement. The upper support section includes an upper body section and a pin member disposed in the transverse bore with the upper body section being pivotally coupled to the pin member.

More specifically, the body section may include a bracket member located at a lower end thereof and pivotally attached to the pin member. The body section includes pivotal coupling means located at an upper end thereof for pivotally connecting the support mechanism at said point along the firing barrel. The intermediate joint means includes a sleeve element mounted around the intermediate support section and the upper body section to move longitudinally with respect to the body section between a locking rest position and a shifted position. Biassing means urges the sleeve element toward its rest position. Such biassing means may include abutment means located on the upper support section and spring means located between the abutment means and the sleeve element. The intermediate support section may include an upper face having a beveled peripheral portion which forms an upper stop for the movable sleeve element in its shifted position.

The main weight of the projector barrel is received by the cradle in which it rotates about an axis of rotation. Thus, the action for bending and extending the support for adjusting the height can be done manually without additional structure. At the same time, in special situations, the support means can be extended using an additional servo device which may include a suitable linkage or the aid of a threaded spindle.

BRIEF DESCRIPTION OF DRAWINGS

Other objects of this invention will appear in the following description and claims, reference being made to the accompanying drawings forming a part of the specification wherein like reference characters designate corresponding parts in the several views.

DETAILED DESCRIPTION

Figure 1:
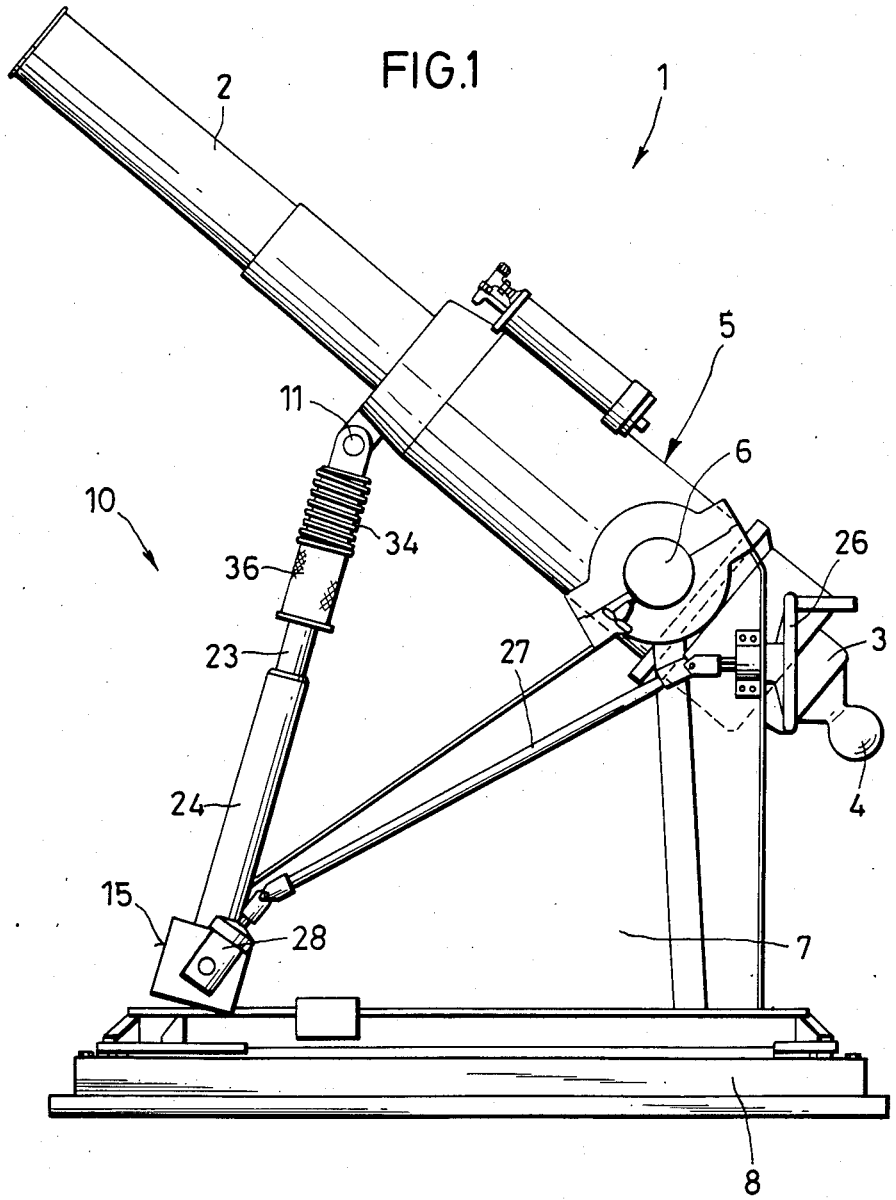
FIG. 1 is an elevational diagrammatic view of a shell launcher totally connected to a height adjustment apparatus of the invention.

FIG. 1 shows a shell launcher, generally designated 1, including a firing barrel 2 having a closed closure cap 3 and a breech ring 4 located at the lower end thereof. Breech ring 4 is designed for a pivotal engagement with a base plate arranged on a floor, the ground, a base mechanism, or the like. Such a pivotal connection is well known in the art. The projector barrel 2 is coupled to a recoil brake mechanism 5 pivotally mounted with transverse pins 6 disposed in a cradle 7 carried by a base plate 8.

The height adjustment apparatus, generally designated 10, includes an upper support section 12, a lower support section 13, and an intermediate joint section 14. Shaft 11 pivotally connects the upper end of the apparatus 10 at a point along the firing barrel 2 and laterally displaced from the axis of rotation of pins 6 in cradle 7. The upper end of apparatus 10 is pivotally connected to the recoil brake mechanism 5 as shown.

A longitudinal adjustment mechanism is located in the lower support section 13 with the intermediate joint mechanism 14 being located above the lower section 13.

Lower support section 13 includes a housing 15 containing a drive shaft 16 which carries first bevel gear 17 engaging a second bevel gear 18. An inner sleeve member 20 is fixedly connected to axle 19 carrying bevel gear 18. Sleeve 20 has an outer threaded surface 21 fixedly connected to bushing element **21*a* which rotates therefore with sleeve 20. A counter thread 22 connects element 21*a* to barrel member 23 which is enclosed by a protective jacket 24. Thus, when threaded sleeve 20 is rotated, element 21*a* rotates and the counter thread 22 causes barrel member 23 to move in an axial direction out of or into jacket 24 depending upon the direction of rotation. Jacket 24 is fixedly connected to housing 15**.

A hand wheel 26 connected to a gear unit 28 via guide rod 27 is used to manually rotate drive shaft 16. The gear mechanism includes the gear unit 28, and bevel gears 17 and 18 operating as described above. The gear mechanism is effective to change rotational movement into longitudinal movement with respect to the height adjustment means 10.

The intermediate joint mechanism includes an intermediate support section 30 fixedly mounted at the end of barrel member 23 to move longitudinally with respect to the lower support section 13. Intermediate support section 30 includes a transverse bore 31 which receives a pin 32 which pivotally connects the intermediate support section 30 to the upper support section 12. The upper support section 12 includes a bracket member 33 which has an opening that surrounds pin 31 and has a curved outer surface 38 to facilitate the bending of the upper support section 12 with respect to the lower support section 13. Upper support section 12 includes an upper body section 34 which includes the pivotal coupling pin 11 located at an upper end thereof for pivotally connecting the support means at a point along the firing barrel 2.

Figure 2:
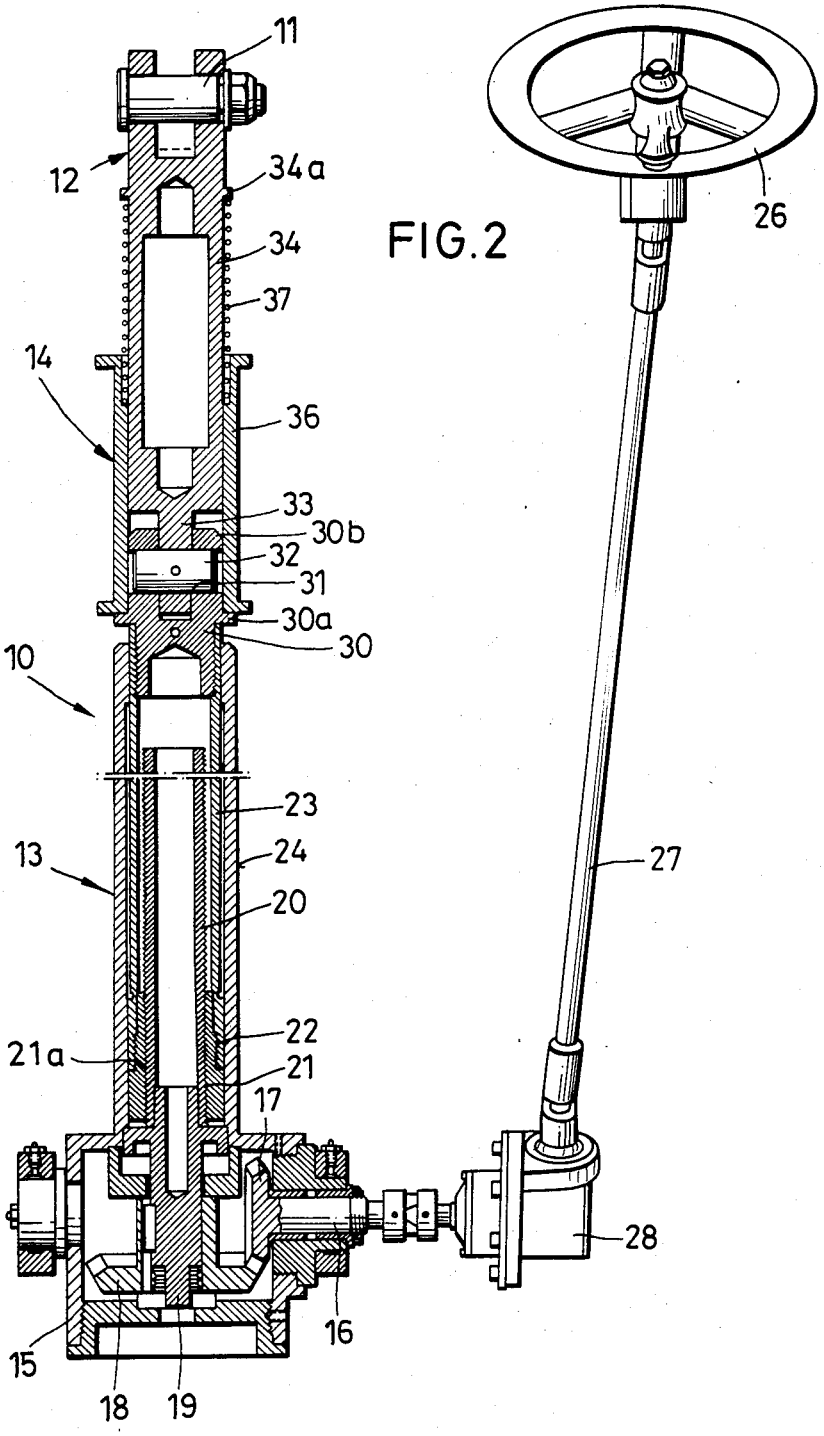
FIG. 2 is a longitudinal cross-sectional view through the height adjustment apparatus of the invention in its extended rest position.
Figure 3:
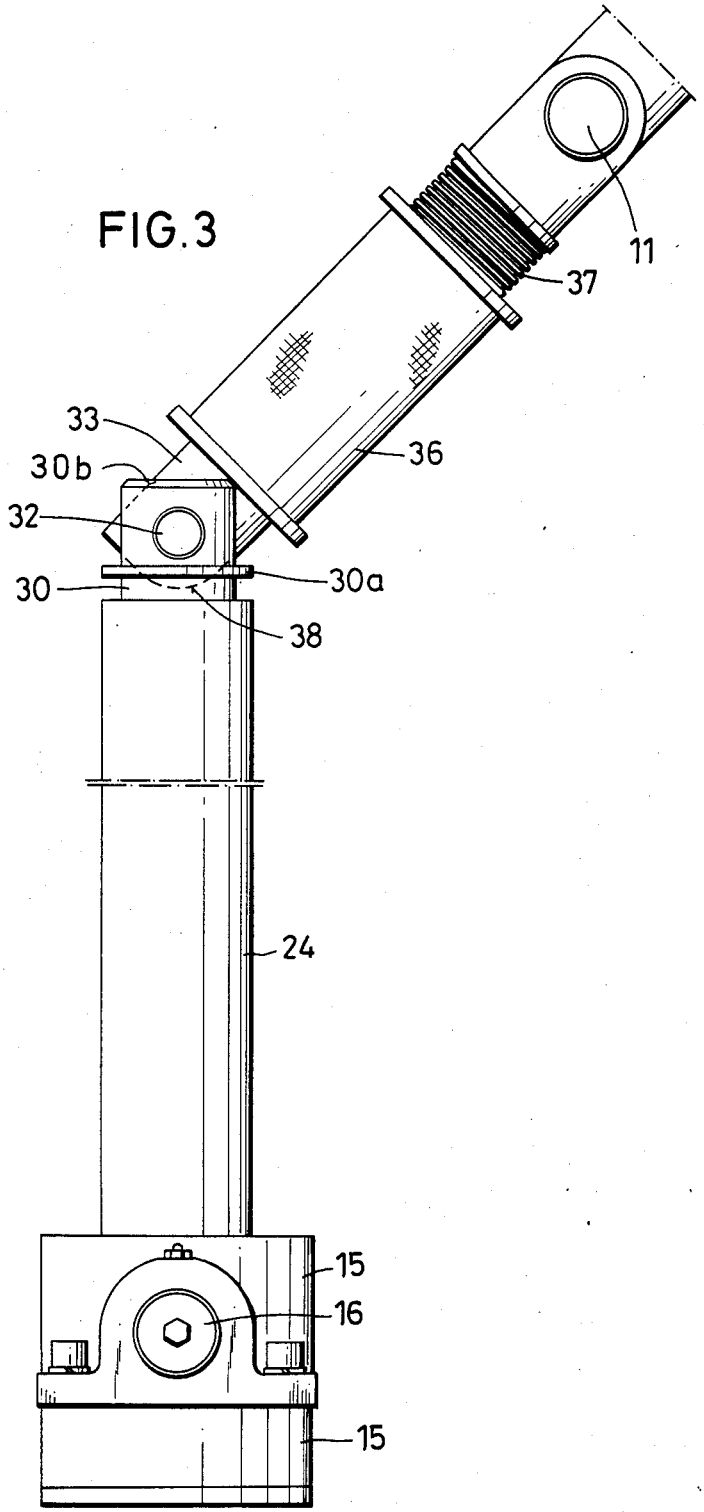
FIG. 3 is an elevational schematic view of the height adjustment apparatus of the invention in its bent position.

The intermediate joint mechanism 14 includes sleeve element 36 mounted around the intermediate support section 30 and the upper body section 34 to move longitudinally with respect to the body section 34 between a locking rest position as shown in FIG. 2 and a shifted position as shown in FIG. 3. A spring 37 and abutment flange **34*a* constitute biassing means urging the sleeve element 36 toward its locking rest position against the flange 30*a* on intermediate section 30**.

With sleeve element 36 in its locking rest position as shown in FIG. 2, pivoting of body section 34 around the axis of pin 32 is impossible. That is, sleeve element 36 constitutes a means for locking upper support section 12 in its locked, extended rest position with respect to lower support section 13. When sleeve element 36 is moved manually under the compression of spring 37 located between abutment flange **34*a* and sleeve element 36 as shown, bracket 33 becomes free to rotate about pin 32 to a bent position as shown in FIG. 3. In the shifted position of sleeve element 36 as shown in FIG. 3, the intermediate support section 30 includes an upper face having a beveled peripheral portion 30*b* which forms an upper stop for movable sleeve element 36 in its shifted position. Thus, as is evident herein, sleeve element 36 is releasable to suddenly or quickly change the angular position of barrel 2 by releasing upper support section 12 to pivotally move to its bent position. As shown, spring 37 is under compression when sleeve element 36** is in its shifted position.

Figure 4:
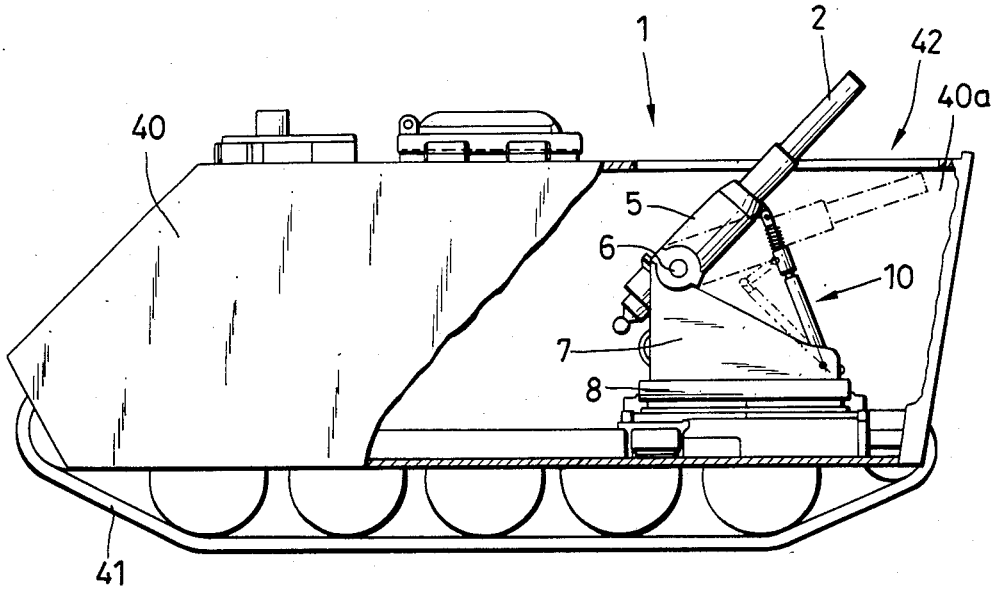
FIG. 4 is a fragmentary elevational view showing a shell launcher with a height adjustment apparatus of the invention mounted in a vehicle.

In FIG. 4, the height adjustment apparatus 10 is shown on a shell launcher 1 housed in a vehicle 40 via cradle 7 and base plate 8. Caterpillar chain 41 moves the vehicle 40 along the ground. Shell launcher 1 is shown in the firing position with projector barrel 2 disposed in a steep position in solid lines. Height adjustment apparatus 10 maintains the projector barrel 2 in a steep firing position when the device is in its locked, extended rest position as shown. In this position, the projector barrel projects outwardly over the structure of vehicle 40.

Upon the necessity of putting the projectile barrel 2 into a stored position inside vehicle 40, sleeve member 36 is manually moved upwardly and the upper support section 12 bends inwardly in a direction toward the firing barrel 2 as shown in FIG. 4. Thus, projector barrel 2 is in a flat-lying, stored position in a very simple and quick manual operation. Once inside structure 40*a* of vehicle 40, projector barrel 2 can no longer be seen from the outside. Structure 40*a* may then be closed by a cover 42 such as a plate so that the shell launcher 1 can no longer be seen from above. Clearly, projector barrel 2 may be moved between the bent position and back to the locked, extended rest position without the height adjustment apparatus itself being adjusted using the wheel 26.

The intermediate joint mechanism of this invention makes it possible to load the projector barrel under cover so that it can be fired in its aiming angle without the crew having to leave cover. In such an instance, a barrel is used having a firing pin mechanism instead of a fixed firing pin in the breech ring.

While the height adjustment apparatus for the firing of a shell launcher has been shown and described in detail, it is obvious that this invention is not to be considered as limited to the exact form disclosed, and that changes in detail and construction may be made therein within the scope of the inqention without departing from the spirit thereof.

Having thus set forth and disclosed the nature of this invention, what is claimed is:

1. Height adjustment apparatus for the firing barrel of a shell launcher, said apparatus comprising:

(a) means mounting a firing barrel to pivot about an axis of rotation for movement to various tilt positions, and (b) support means pivotally connected at a point along the firing barrel and laterally displaced from the axis of rotation, (c) said support means including an upper support section, a lower support, and joint means for pivotally moving the upper support section between a locked, extended rest position and a bent position with respect to the lower support section, (d) said firing barrel being in a firing position when the upper support is in the locked, extended rest position and in a stored position when the upper support section is in bent position, (e) said joint means including means for locking the upper support section in said locked rest position, (f) said locking means being releasable to quickly change the angular position of the firing barrel to a stored position.

2. An apparatus as defined in claim 1 wherein the upper support section bends inwardly in a direction toward the firing barrel when said locking means is released.

3. An apparatus as defined in claim 1 wherein the firing barrel mounting means includes a cradle and transverse pins rotatably disposed on the cradle to allow the firing barrel to pivot about said axis of rotation.

4. An apparatus as defined in claim 1 wherein the support means includes means for longitudinally adjusting the length of the upper means.

5. Height adjustment apparatus for the firing barrel of a sheel launcher, said apparatus comprising:

(a) means mounting a firing barrel to pivot about an axis of rotation for movement to various tilt positions, and (b) support means pivotally connected at a point along the firing barrel and laterally displaced from the axis of rotation, (c) said support means including an upper support section, a lower support section, and intermediate joint means for pivotally moving the upper support section between an extended rest position and a bent position with respect to the lower support section, (d) said firing barrel being in a firing position when the upper support section is in the extended rest position and in a stored position when the upper support section is in the bent position, (e) the lower support section including means for longitudinally adjusting the length of the support means, and (f) the upper support section bends inwardly in a direction toward the firing barrel at a location above the longitudinally adjusting means.

6. An apparatus as defined in claim 5 wherein the adjusting means includes a gear mechanism for changing rotational movement into longitudinal movement with respect to said support means.

7. An apparatus as defined in claim 6 wherein the adjusting means includes manually operated control means to activate said gear mechanism.

8. Height adjustment apparatus for the firing barrel of a shell launcher, said apparatus comprising:

(a) means mounting a firing barrel to pivot about an axis of rotation for movement to various tilt positions, and (b) support means pivotally connected at a point along the firing barrel and laterally displaced from the axis of rotation, (c) said support means including an upper support section, a lower support section, and intermediate joint means for pivotally moving the upper support section between an extended rest position and a bent position with respect to the lower support section, (d) said firing barrel being in a firing position when the upper support section is in the extended rest position and in a stored position when the upper support section is in the bent position, (e) the joint means including an intermediate support section mounted to move longitudinally with respect to the lower support section and pivotally connected to the upper support section.

9. Height adjustment apparatus for the firing barrel of a shell launcher, said apparatus comprising:

(a) means mounting a firing barrel to pivot about an axis of rotation for movement to various tilt positions, and (b) support means pivotally connected at a point along the firing barrel and laterally displaced from the axis of rotation, (c) said support means including an upper support section, a lower support section, and intermediate joint means for pivotally moving the upper support section between an extended rest position and a bent position with respect to the lower support section, (d) said firing barrel being in a firing position when the upper support section is in the extended rest position and in a stored position when the upper support section is in the bent position, (e) the lower support section including means for adjusting the length of the support means for changing the tilt position of the firing barrel, (f) the joint means including an intermediate support section mounted to said adjusting means for longitudinal movement with respect to the lower support section.

10. An apparatus as defined in claim 9 wherein the adjusting means includes a longitudinally adjustable barrel member having an outer end connected to the intermediate support section, the intermediate support section includes a transverse bore extending in a direction transverse to the direction of longitudinal movement, and the upper support section includes an upper body section and a pin member disposed in said transverse bore with the upper body section being pivotally coupled to said pin member.

11. An apparatus as defined in claim 10 wherein the body section includes a bracket member located at a lower end thereof and pivotally attached to said pin member, and the body section includes pivotal coupling means located at an upper end thereof for pivotally connecting said support means at said point along the firing barrel.

12. An apparatus as defined in claim 11 wherein the joint means includes a sleeve element mounted around the intermediate support section and the upper body section to move longitudinally with respect to said body section between a rest position and a shifted position, the intermediate support section includes an upper face having a beveled peripheral portion which forms an upper stop for the movable sleeve element in said shifted position.

13. An apparatus as defined in claim 12 wherein the intermediate support section includes a lower stop means against which the movable sleeve element abuts in said rest position, said sleeve element being effective to hold the upper support section in its said extended rest position when said sleeve element is in its said rest position, said upper support section being in its said bent position when said sleeve element is in its said shifted position.

14. Height adjustment apparatus for the firing barrel of a shell launcher, said apparatus comprising:

(a) means mounting a firing barrel to pivot about an axis of rotation for movement to various tilt positions, and (b) support means pivotally connected at a point along the firing barrel and laterally displaced from the axis of rotation, (c) said support means including an upper support section, a lower support section, and intermediate joint means for pivotally moving the upper section between an extended rest position and a bent position with respect to the lower support section, (d) said firing barrel being in a firing position when the upper support section is in the extended rest position and in a stored position when the upper support section is in the bent position, (e) the joint means including an intermediate support section mounted to move longitudinally with respect to the lower support section and pivotally connected to the upper support section, (f) said joint means further including a sleeve element mounted around the intermediate support section and the upper support section to move longitudinally with respect to said upper support section between a rest position and a shifted position, (g) said sleeve element being effective to hold the upper support section in its said extended rest position when said sleeve element is in its said rest position, (h) said upper support section being in its said bent position when said sleeve element is in its said shifted position.

15. An apparatus as defined in claim 14 wherein said joint means includes biassing means to urge the sleeve element toward its rest position.

16. An apparatus as defined in claim 15 wherein said biassing means includes abutment means located on the upper support section and spring means located between the abutment means and the sleeve element.

17. Height adjustment apparatus for the firing barrel of a shell launcher, said apparatus comprising:

(a) means mounting a firing barrel to pivot about an axis of rotation for movement to various tilt positions, and (b) support means pivotally connected at a point along the firing barrel and laterally displaced from the axis of rotation, (c) said support means including an upper support section, a lower support section, and intermediate joint means for pivotally moving the upper section between an extended rest position and a bent position with respect to the lower support section, (d) said firing barrel being in a firing position when the upper support section is in the extended rest position an in a stored position when the upper support section is in the bent position, (e) the joint means including an intermediate support section mounted to move longitudinally with respect to the lower support section and pivotally connected to the upper support section, (f) said intermediate support section including a transverse bore extending in a direction transverse to the direction of longitudinal movement, and (g) the upper support section including a bracket member located at a lower end thereof and pivotally attached to a pin member disposed in said transverse bore.

18. An apparatus as defined in claim 17 wherein the bracket member includes a curved outer surface to facilitate the bending of the upper support section with respect to the lower support section.

19. An apparatus as defined in claim 1 wherein the firing barrel is mounted to a recoil brake mechanism which includes transverse mounting pins for disposition in a support cradle.

* * * * *